United States Patent [19]

Mori et al.

[11] 4,421,536

[45] Dec. 20, 1983

[54] PROCESS FOR PRODUCING KRYPTON AND XENON

[75] Inventors: Tatsuo Mori, Yokohama; Juichi Ishii, Sakura, both of Japan

[73] Assignee: Nippon Sanso K.K., Tokyo, Japan

[21] Appl. No.: 296,151

[22] Filed: Aug. 25, 1981

[30] Foreign Application Priority Data

Aug. 29, 1980 [JP] Japan ..... 55-119441

[51] Int. Cl.[3] ..... F25J 3/04

[52] U.S. Cl. ..... 62/18; 62/22; 62/30

[58] Field of Search ..... 62/22, 29, 30, 18

[56] References Cited

U.S. PATENT DOCUMENTS 2,060,940 11/1936 Kahle ..... 62/22
3,222,879 12/1965 Stoklosinski ..... 62/22
3,596,471 8/1971 Streich ..... 62/22
3,768,270 10/1973 Schuftan ..... 62/22
3,779,028 12/1973 Schuftan et al. ..... 62/22

*Primary Examiner*—Frank Sever
*Attorney, Agent, or Firm*—Darby & Darby

[57] ABSTRACT

A process for producing krypton and xenon. The concentrations of krypton and xenon contained in liquid oxygen are not highly increased in a concentrating column to produce concentrated liquid having a relatively low concentration of methane, which is stripped of methane by contact with oxygen gas in a methane purging column to reduce the methane concentration and the methane-purged liquid is then concentrated at the lower part of the purging column. Then, the concentrated liquid is vaporized and purified by catalitic combustion and adsorption, and thereafter a mixture of krypton and xenon is separated from the purified gas in a second concentrating column.

9 Claims, 1 Drawing Figure

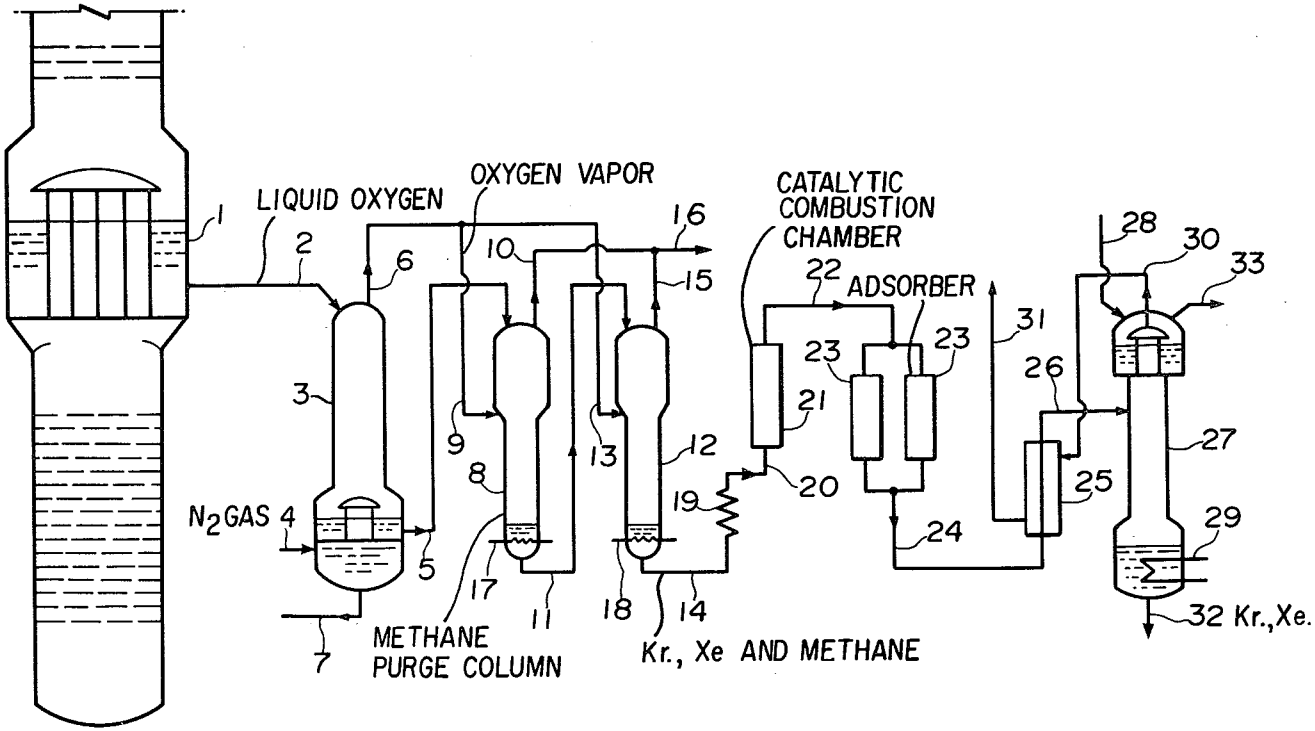
LIQUID OXYGEN
OXYGEN VAPOR
CATALYTIC COMBUSTION CHAMBER
ADSORBER
Kr., Xe AND METHANE
METHANE PURGE COLUMN
N2 GAS
Kr., Xe.

PROCESS FOR PRODUCING KRYPTON AND XENON

BACKGROUND OF THE INVENTION

This invention relates to a process for producing krypton and xenon in which liquid oxygen obtained under rectification by means of an air separation plant is concentrated, and in which krypton and xenon contained in the thus concentrated liquid are recovered safely and efficiently.

In recovering industrially krypton and xenon contained in air, it is a common practice to rectify liquid oxygen which has been separated in a main condenser evaporator of the air separation plant, to concentrate krypton and xenon contained in the rectified liquid to obtain a gas mixture of krypton and xenon, and then to purify and separate the gas mixture, whereby pure krypton and xenon are separately produced. Hydrocarbons included in air are also carried into the liquid oxygen, and are hence concentrated during the concentrating process of krytpon and xenon. The enrichment of the liquid with hydrocarbons, particularly methane is liable to cause explosion. To avoid this explosion hazard, removal of hydrocarbons by adsorption or replacement of oxygen by inert gases such as argon is conventionally carried out. It is however difficult to completely remove hydrocarbons by adsorption. Also, it is insufficient to remove hydrocarbons by using the method of catalitic combustion and adsorption of water and carbon dioxide which are combustion products thereby to eliminate the danger of the explosion of hydrocarbons, because the ratio of the supplied liquid oxygen to the concentrated liquid in the concentrating step should be kept under range of the methane 150–180 in view of explosion limit concentration. In the process replacing oxygen by inert gases such as argon gas, there are disadvantages that an argon extraction system must be provided in the air separation plant, and further that expensive argon is consumed.

SUMMARY OF THE INVENTION

Accordingly, it is an object of the invention to provide a process for producing krypton and xenon in which krypton and xenon are concentrated without raising hydrocarbon concentration too high, whereby safety can be greatly enhanced.

It is a further object of the invention to provide a process for producing krypton and xenon in which the concentration of xenon which is valuable for industrial purposes is highly raise thereby to increase the yield of xenon.

It is another object of the invention to provide a process for producing krypton and xenon in which the concentration of methane contained in the liquid oxygen is maintained low during the concentration process compared to the prior art, so that krypton and xenon can be concentrated to a high degree and the amount of treatment gas to be processed in the later stages becomes relatively small which enables the combustion and absorption of methane gas to be easily performed, and which allows units used for such steps to be made compact.

These and other objects of the invention are achieved by a process for producing krypton and xenon in which concentrations of krypton and xenon contained in the liquid oxygen are not highly increased in the concentrating column to produce concentrated liquid having a low concentration of methane, which is stripped of methane by contact with oxygen gas in a methane purging column to reduce the methane concentration and the methane-purged liquid is then concentrated at the lower part of the purging column.

BRIEF DESCRIPTION OF THE DRAWINGS

The FIGURE is a flowsheet of one embodiment of the process according to the present invention.

DETAILED DESCRIPTION OF THE INVENTION

Referring now to the FIGURE, reference numeral 1 designates a main condenser of an air separation plant, from which liquid oxygen containing small concentrations of krypton, xenon and hydrocarbons is extracted and is supplied through a line 2 to the top of a first concentrating column 3. On the other hand, nitrogen gas for heating is fed from the air separation plant through a line 4 to the bottom of the column 3. The liquid oxygen fed to the top of the concentrating column 3 is rectified and concentrated in the column 3. As a result, a concentrated liquid containing krypton, xenon, and hydrocarbons flows out of a condensed section at the bottom of the concentrating column 3 through a line 5 while oxygen gas containing methane issues from a line 6. The nitrogen gas which was supplied for heating through pipe 4 is liquefied and accumulated in the bottom of the concentrating column 3 and is then returned back through a pipe 7 to the air separation plant.

The concentrated liquid flowed out through the line 5 is fed to the top portion of a first methane purging column 8 of a conventional type, for example, a rectification column. On the other hand, the bulk of the reduced methane-concentration oxygen gas flowed out through the line 6 is injected through a line 9 into a middle portion of the purging column 8 and moved upwards accompanying with methane contained in the concentrated liquid which is fed in the top of the column 8 and fallen in it, and then is discharged through a pipe 10 with an increased concentration of methane gas. This purging lowers greatly the concentration of the methane contained in the concentrated liquid, but the liquid is re-concentrated and at the bottom of the column 8 becomes substantially the same in the concentration of methane as the liquid at the top of the column. Simultaneously, krypton and xenon in the liquid are also concentrated. Thus-methane-purged concentrated liquid is extracted through a line 11, is fed into a top portion of a second methane purging column 12 of a well-known type, and is then methane purged as in the column 8 by the remaining oxygen gas derived from the top of the concentrating column 3 and then injected through a line 13 into a middle portion of the column 12. As a result, oxygen-rich liquid containing considerable concentrations of krypton and xenon relatively small concentrations of methane and other hydrocarbons is flowed out of the bottom of the second methane purging column 12 through a line 14, while the oxygen-rich gas carrying the methane gas is discharged from the top of the column 12 through a line 15 and is returned back through a line 16 to the air separation plant together with the oxygen-rich gas flowing out through the line 10 of the first methane purging column 8. At the bottom portions of the methane purging column 8 and 12, there are respectively provided heating means 17 and 18 such as heater for generating heat necessary for rectification.

The concentrated liquid extracted through the line 14 is introduced into and evaporated by a heater 19 and then enters through a line 20 a catalytic combustion cylinder or reactor 21, where the bulk of hydrocarbons contained in the evavopated liquid is burnt to generate water and carbon dioxide, which are thereafter introduced through a line 22 into one of adsorption units 23 which can be switched over to the other, where the water and carbon dioxide are adsorbed and removed. The hydrocarbon-purged or purified gas enters through a line 24 a heat exchanger 25 for cooling and is then fed through a line 26 to the middle portion of second concentrating column 27 of a conventional type where rectification is carried out by supplying liquid oxygen through a line 28 to the condensation section at the top of the column 27 and by providing oxygen gas or air through a line 29 to a heating section at the bottom of the column 27 from the air separation plant. Consequently, a liquid mixture of krypton and xenon is accumulated at the bottom of the second concentrating column 27, and oxygen gas issues through a line 30 from the top of the condensation section. The oxygen gas cools at the heat exchanger 25 the gas mixture to be fed to the column 27 and then flows out through a line 31. On the other hand, the liquid mixture of krypton and xenon is drawn through a line 32 and then undergoes well-known purifying steps such as combustion, absorption, etc, after which the purified gases are rectified and separated into pure krypton gas and xenon gas. The vaporized part of the liquid oxygen for cooling which has been supplied through the line 28 issues out of a line 33, and is returned back to the air separation plant as well as the oxygen gas flowing out of the lines 29 and 31.

In the above embodiment, the methane purging is performed in two stages by the use of two methane purging columns, but it may be carried out in a single or more than two stages. Also, only methane purging may be carried out without reconcentration of the concentrated liquid in the first methane purging column and/or the second methane purging column. The oxygen gas for stripping methane in the methane purging column is not limited to the oxygen gas obtained from the top of the concentration column, but oxygen gas, from whatever oxygen source it may be obtained, can be used for the methane purging process, if it contains a small amount of methane. The nitrogen gas supplied from the air separation plant for the purpose of heating the concentrating column may be substituted by air, oxygen gas, or argon gas provided from the plant, or by the oxygen gas under pressure which has been stripped of methane in the methane purging column. Further, these heating air, nitrogen gas, argon gas, etc. may be recycled by a recycle compressor, so that the present krypton and xenon recovering system is supplied only with liquid oxygen as raw material from the air separation plant thereby to achieve stabilization of the operation of the plant. Instead of this recycle method for heating the concentrating column, the oxygen gas discharged from the top of the concentrating column may be used as a heating gas after being heated, compressed, and cooled.

EXAMPLE

A plant for recovering krypton and xenon of the type illustrated in the FIGURE was built and tested. Liquid oxygen containing 80 ppm of krypton, 25 ppm of xenon, 55 ppm of methane and a trace amount of other hydrocarbons was fed from an air separation plant through the line 2 to the concentration column 3 at a rate of 100 $Nm^3/h$. As a result of the rectification process in the concentration column 3, concentrated liquid containing 500 ppm of xenon, 1000 ppm of methane, etc. was flowed out through the line 5 at a rate of 5 $Nm^3/h$, and an oxygen gas containing 7 ppm of methane issued through the line 6 at a rate of 95 $Nm^3/h$. The oxygen gas was injected into the first methane purging column 8 through the line 9 at a rate of 87 $Nm^3/h$. This purging process caused oxygen gas containing 55 ppm of methane to be discharged through the line 10 and also caused concentrated liquid 6000 ppm (0.6%) of xenon and 1,000 ppm of methane to be flowed out through the line 11 at a rate of 0.42 $Nm^3/h$. The concentrated liquid was introduced into the second methane purging column 12. The remaining oxygen gas injected through the line 13 into the second methane purging column 12 at a rate of 8 $Nm^3/h$. As a result, a liquid mixture containing 5.3% of krypton, 3.3% of xenon, 500 ppm of methane, 300 to 400 ppm of the other hydrocarbons, and the remaining part of oxygen was obtained from the line 14 at a rate 0.07 $Nm^3/h$. It is to be noted that the concentration of methane contained in the concentrated liquid reaches according to the prior process about 8000 to 10000 ppm (0.8–1%), but is according to the present invention about 1/10 of that level even in the case of maximum concentration.

What is claimed is:

1. A process for producing krypton and xenon, comprising the steps of:

supplying to a first concentrating column liquid oxygen containing small concentrations of krypton, xenon, and hydrocarbons including methane accumulated in a main condensation section of an air separation plant;

rectifying and concentrating said liquid oxygen in the first concentrating column in which concentrations of said Kr,Xe and hydrocarbons are increased;

introducing the concentrated liquid into a methane purging column;

maintaining operation conditions within the purging column below explosive limits solely by bringing said concentrated liquid into countercurrent contact with oxygen gas introduced into the purging column in the absence of extraneous argon gas, and purging the methane with the oxygen from the top of the purging column;

bringing out of the methane purging column and vaporizing the concentrated liquid remaining in the bottom of the purging column;

thereafter effecting combustion of the vaporized concentrated liquid in a catalytic combustion reactor;

absorbing and removing water and carbon dioxide produced from the combustion for producing a purified gas mixture; and separating a mixture of krypton and xenon from the purified gas mixture in a second concentrating column.

2. A process as recited in claim 1, wherein oxygen gas issuing from the top of the first concentration column is supplied as oxygen gas for purging to the methane purging column.

3. A process as recited in claim 1, wherein the methane purging step is repeated in at least two methane purging columns.

4. A process as recited in claim 3, wherein said liquid concentrated in the first concentrating column is reconcentrated, after countercurrent contact with oxygen gas, in at least one of the methane purging columns.

5. A process as recited in claim 1, wherein said liquid concentrated in the first concentrating column is reconcentrated, after countercurrent contact with oxygen gas, in the methane purging column.

6. A process as recited in claim 1, wherein said first concentrating column is heated by nitrogen gas, argon gas, or air which are extracted from the air separation plant.

7. A process as recited in claim 1, wherein said first concentrating column is heated by nitrogen gas, or air which are recycled in a recycle system, whereby stabilization of the operation of the air separation plant is achieved.

8. A process as recited in claim 1, wherein said first concentrating column is heated by the oxygen gas which is discharged from the top thereof.

9. A process as recited in claim 1, wherein said first concentrating column is heated by the oxygen gas which discharged from the top of the methane purging column.

* * * * *